US005422627A

United States Patent [19]

Tap et al.

[11] Patent Number: 5,422,627

[45] Date of Patent: Jun. 6, 1995

[54] SEALING SYSTEM FOR AN OBJECT AND SEAL THEREFOR

[75] Inventors: Geert E. Tap, Arnhem; Richard H. Rieksen, Huissen, both of Netherlands

[73] Assignee: N.V. Kema, Netherlands

[21] Appl. No.: 194,840

[22] Filed: Feb. 14, 1994

[30] Foreign Application Priority Data

Feb. 12, 1993 [NL] Netherlands ..... 9300283

[51] Int. Cl.[6] ..... E05B 45/06; E08B 13/14

[52] U.S. Cl. ..... 340/542; 340/568

[58] Field of Search ..... 235/380, 379; 902/4, 902/5; 340/542, 545, 547, 550, 548, 568; 70/439

[56] References Cited

U.S. PATENT DOCUMENTS

| | | | |
|---|---|---|---|
| 4,449,115 | 5/1984 | Koerner | 340/568 |
| 4,592,119 | 7/1985 | Granzow et al. | 70/439 |
| 4,663,611 | 5/1987 | Humphrey | 340/542 |
| 4,813,564 | 3/1989 | Cooper et al. | 215/336 |
| 5,029,291 | 7/1991 | Zhou et al. | 340/561 |
| 5,189,398 | 2/1993 | Stobbe | 340/541 |

FOREIGN PATENT DOCUMENTS

| | | | |
|---|---|---|---|
| 0463294 | 6/1991 | European Pat. Off. | 215/336 |
| 2667576 | 10/1990 | France | 215/336 |
| 2109109 | 5/1983 | United Kingdom | 70/439 |
| 9202918 | 2/1992 | WIPO . | |

*Primary Examiner*—Donald Hajec
*Assistant Examiner*—Thien Minh Le
*Attorney, Agent, or Firm*—Webb Ziesenheim Bruening Logsdon Orkin & Hanson

[57] ABSTRACT

The invention relates to a sealing system for an object comprising a locking member closing the object, a seal coupled to the locking member and provided with integrity arrangement, and a sensor with which the response of the integrity arrangement, and therewith the integrity of the seal, can be determined, wherein preferably the integrity arrangement comprise magnetic material with a low magnetic coercivity and/or a transponder, and to a seal for such a sealing system.

15 Claims, 3 Drawing Sheets

SEALING SYSTEM FOR AN OBJECT AND SEAL THEREFOR

BACKGROUND OF THE INVENTION

The present invention relates to a sealing system for an object with which can be ascertained whether access has been gained to this object in undesired manner. The present invention relates more particularly to a sealing system for an object, wherein the object is closed with at least one locking member, and it can be ascertained with the sealing system whether the locking member has been used to gain access to the object.

DESCRIPTION OF THE PRIOR ART

The object for which the sealing system according to the invention can be applied comprises for instance a meter casing for recording for example the amounts of electricity, water and gas consumed, and further all types of containers and holders holding security papers such as money. With all such objects it is necessary to be able to determine whether third parties have gained access in undesired manner to the contents of the object, for instance to influence the meter reading or the functioning of the recording equipment.

Known sealing systems comprise a seal wire and a lead seal connected non-releasably thereto and optionally provided with a logo. Such a sealing system is very susceptible to fraud since seal wire and the seal used, whether or not provided with logo, are easy for third parties to copy.

SUMMARY OF THE INVENTION

The invention has for its object to provide a sealing system wherein the integrity of the seal can be determined independently of individual persons and with very great accuracy. This is achieved with a sealing system for an object according to the invention, which sealing system comprises a locking member closing the object, a seal coupled to the locking member and provided with integrity means, and a sensor with which the response of the integrity means, and therewith the integrity of the seal, can be determined. In order to determine the integrity of the seal it suffices only to place the sensor in the vicinity of the seal so that a response of the integrity means forming part of the seal can be determined by the sensor, whereafter the received response signal can be reproduced at choice directly or indirectly.

The integrity means which according to the invention can be applied in the sealing system must fulfil a number of requirements. The integrity means may not be easy to copy, and manipulation of the seal must under all conditions result in the response to be monitored by the sensor having changed in order of magnitude or being wholly absent. In addition the integrity means must be of a nature such that they are not easily available to third parties.

According to a first embodiment the integrity means comprise a magnetic material with a low magnetic coercivity. Per se known materials (U.S. Pat. No. 5,029,291, such as permalloy ®, metglas ® and a laminate with a first layer of ferromagnetic material and a second layer of anti-ferromagnetic material alternatingly connected to the first layer) have specific magnetic properties which can only be programmed in the production process. The magnetic material has a specific BH curve displaying no hysteresis. When the dimensions of the produced magnetic material are changed, this will lead to a sharp, more than proportional change, in this case attenuation, of the specific magnetic properties. Such a sharp attenuation of the magnetic properties will thus occur with a change in the length of a wire or strip of this magnetic material by more than 0.1–1 mm. It is therefore recommended that the magnetic material according to the invention has the form of a wire. A seal well applicable in practice can be obtained by embedding the magnetic material as wire or strip in a plastic seal, for instance a plastic seal manufactured by injection moulding.

According to another embodiment the integrity means can consist of a per se known transponder (Texas Instruments—TIRIS—overview of Technology, Products and Applications [February 1992], doc. number 11-03-001). This transponder consists for instance of a chip melted into a glass tube and provided with and energized by an antenna. By placing the sensor in the vicinity of the transponder the chip will be energized by actuation of the antenna which then transmits a signal which is received and processed by the sensor. Breaking of the seal will result in malfunctioning of the transponder whereby the sensor registers no response or a changed or attenuated response.

In general the seal according to the invention can be applied at those places where at this moment systems are applied for instance consisting of a seal with sealing wire. It is therefore recommended that for the sealing system according to the invention the locking member is a locking screw to which the seal is coupled.

In order to provide the possibility of it being possible not only to ascertain with the sealing system that the seal is undamaged but also to which object the seal belongs, it is further recommended that the seal is provided with a unique code. This unique code is preferably a code which can be read by the sensor, so that this reading can be embodied electronically and independently of the sensor user. An example of such a readable code is the known so-called bar code. In the case of the transponder a unique code is transmitted and received. The advantage is further achieved herein that the seal has itself become unique due to the code added thereto, so that copying of this seal has become substantially uneconomic since, when making copies, unique seals must be manufactured in each case.

In order to make checking of the integrity of the seal electronic and independent of the sensor operator, it is further recommended that the sensor be provided with means for storing the response of the seal. Under these conditions it is even possible that the sensor operator is not capable of observing what type of response is recorded by the sensor. Thus created is a sealing system which is independent of the operator of the sensor and fraudulent operations are no longer possible for him either.

In order to guide the sensor operator according to a determined pattern or along a particular path past one or more objects, it is further recommended that the sensor be provided with a display for reproducing data of the owner of the object. In this case it is also possible to indicate to the operator of the sensor that the object may be provided with more than one seal the integrity of which must be determined.

If in further preference the sensor is provided with means for entering a meter reading recorded by the object, the operator of the sensor can also be used for processing, recording and/or entering meter readings to be read from the object. It is also noted that instead of reading and entering meter readings, these meter readings can also be transmitted electronically when the response of the integrity means is determined with the sensor.

In order to enable a central processing of the response recorded by the sensor and possible other information it is further recommended that the sensor can be coupled to a central processing unit for processing a response measured by the sensor and entered data. It is thus possible to determine the integrity of the seal of a large number of objects in a once-only operation, optionally independently of the observation of the user of the sensor, and simultaneously therewith to optionally read meter readings and other entered information. After the central processing unit has processed all the data, the object can be exposed to a further inspection when the sensor has recorded that the response differs from that of a pristine seal.

Finally, the present invention relates to a seal provided with the integrity means according to the invention, which seal can be applied in the sealing system.

Mentioned and other features of the sealing system and the seal for use therein will be further elucidated hereinbelow in the light of a number of non-limitative embodiments given only by way of example and with reference to the annexed drawings.

DESCRIPTION OF THE PREFERRED EMBODIMENTS

Figure 1:
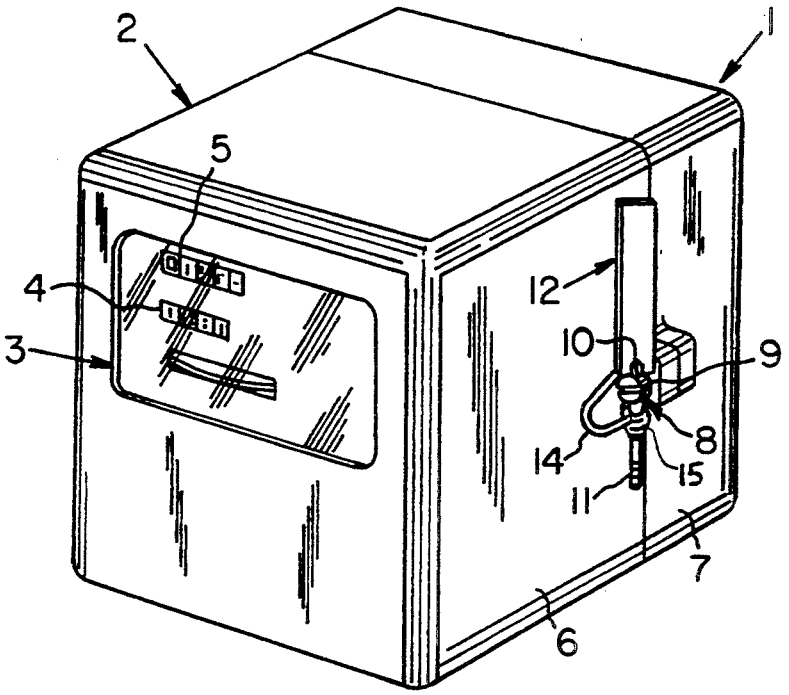
FIGS. 1 and 3 each show an object in the form of a meter casing provided with a seal according to the invention.
Figure 2:
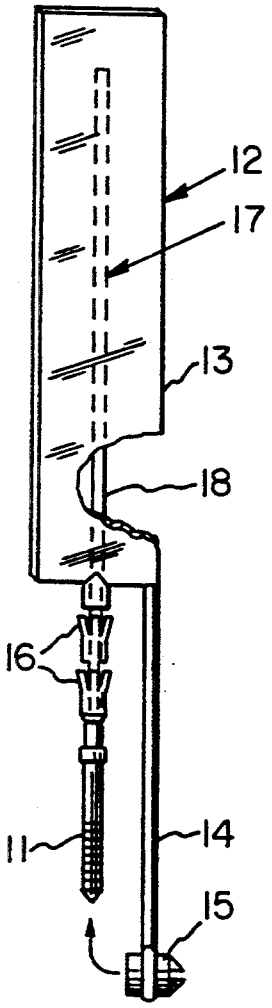
FIGS. 2 and 4 each show on a larger scale a seal according to the invention in partly broken away view.

FIG. 1 shows a part of a sealing system according to the invention for an object 2, in this case a meter casing, which is provided with a window 3 through which counters 4 and 5 show the meter readings for consumed electricity. The object in the form of a divisible casing consisting of the casing parts 6 and 7 is closed with a locking member 8 in the form of a locking screw with an opening 10 which runs through the screw head 9 and through which is inserted a rod 11 of a seal 12. Seal 12 is shown in more detail in FIG. 2. Seal 12 consists of a leaf 13 onto which data can optionally be arranged, the rod 11 and further a closing cap 15 which is connected via a strip to the leaf 13 and which can be placed on the rod 11 and locked thereon with barbs 16 engaging in the closing cap.

Received according to the invention in the seal 12 are integrity means 17, in this case embedded during injection moulding of seal 12. The integrity means comprise in this case a strip or wire 18 of magnetic material with dimensions (0.5–2 mm × 1–10 mm). The wire 18 extends on one side into the leaf 13 and on the other into the rod 11 for placing through the opening 10.

Turning of the locking screw 8 via the screw head 9 will result in a deforming or breaking of the rod and therewith to a deforming or breaking of the magnetic material wire 18.

Figure 6:
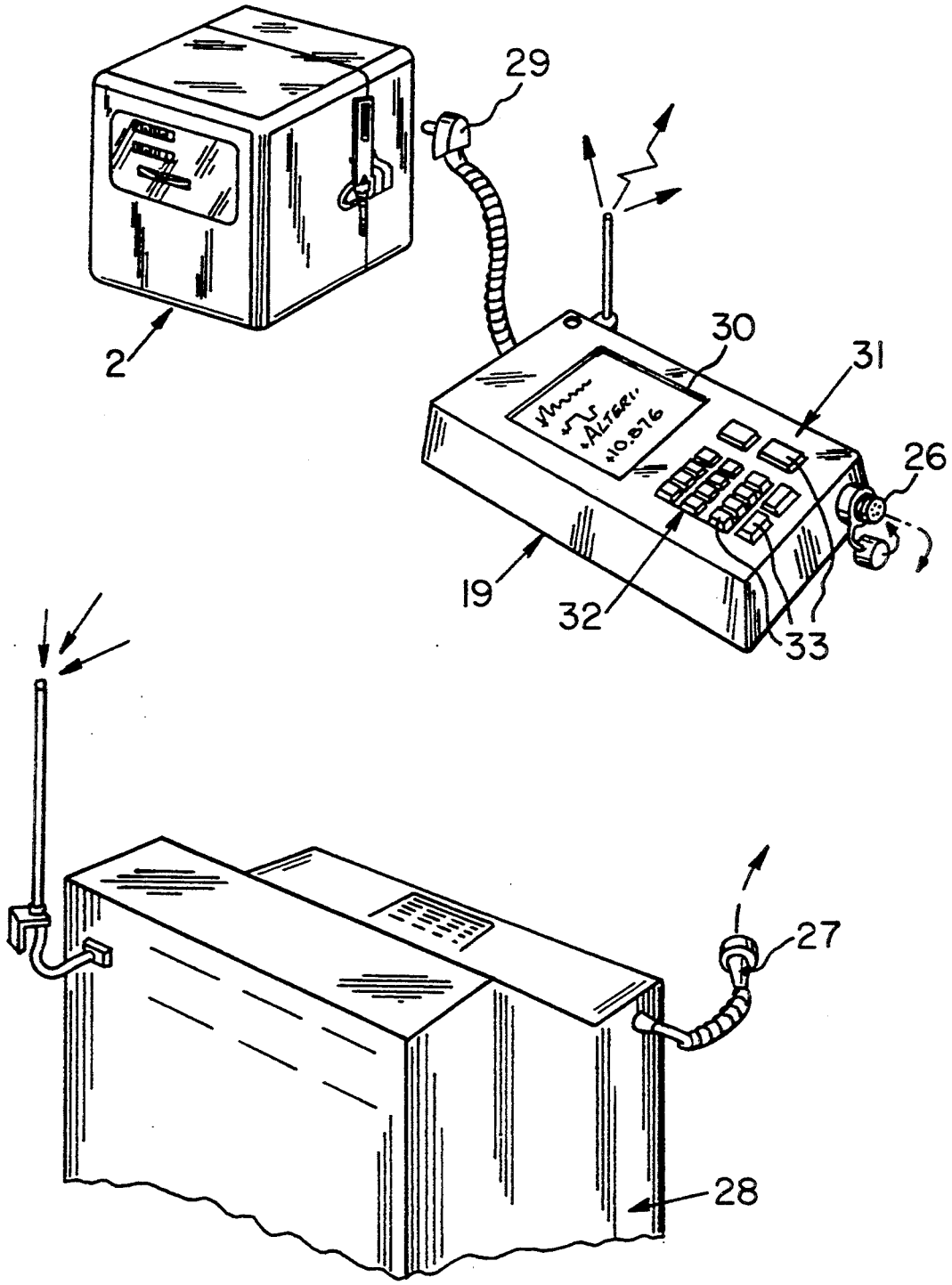
FIG. 6 shows on another scale a sensor of the sealing system according to the invention, which sensor can be coupled by means of a cable to a central processing unit.

When a sensor 19, which will be discussed hereinafter with reference to FIG. 6, is then placed in the vicinity of seal 12, the recorded response or condition of the permalloy will then be changed by deforming or breakage such that the sensor records breakage of seal 12.

Figure 3:
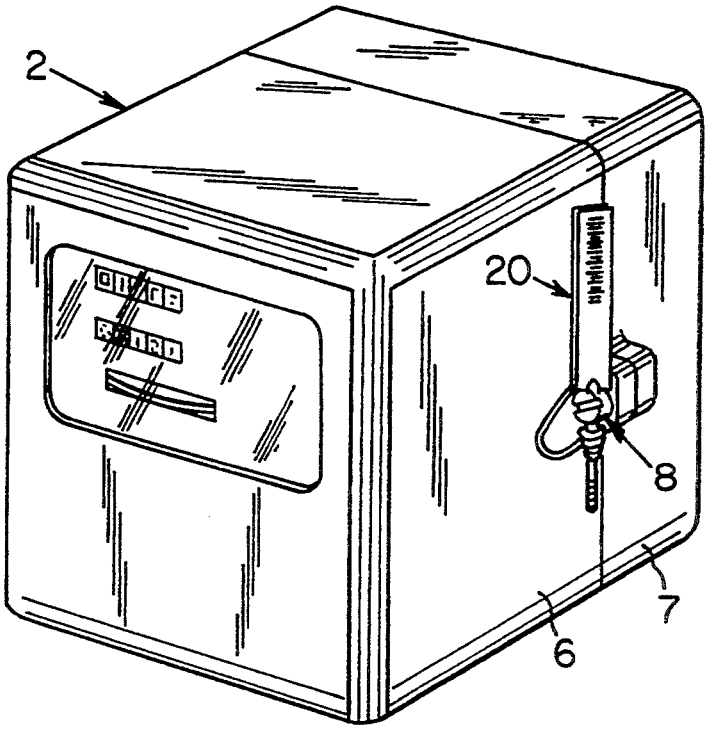

FIG. 3 shows once again the object 2 which is now provided with a seal 20 according to the invention. Seal 20 has the same construction as seal 12 of FIGS. 1 and 2, but the leaf 13 is now also provided with a unique code 21 for the seal 20, namely a so-called bar code. It is now also possible not only to determine the integrity of the seal 20 with sensor 19, but also the actual seal 20 because of the unique code linked thereto.

Figure 5:
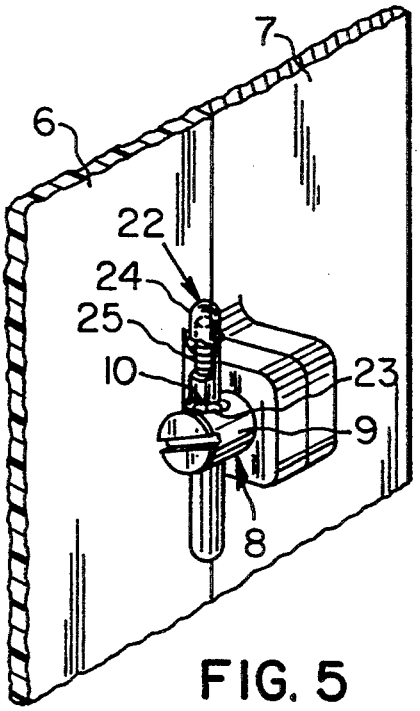
FIG. 5 shows a variant of a seal according to the invention.

FIG. 5 shows another seal 22 according to the invention which in this case is adhered fixedly with glue 23 into the opening 10 of the locking screw 8. Seal 21 has the form of a transponder consisting of a glass tube 24 in which is received an antenna 25 which actuates a chip. When sensor 19 is placed in the vicinity of the transponder seal 22, the chip is actuated by the antenna 24 and information can be emitted by the chip and the antenna to the sensor 19. If the locking screw 8 has been actuated in undesired manner, this will have resulted in bending or breaking of the glass tube 24 and thereby in malfunction of the antenna/chip. A response monitored by sensor 19 will therefore be deformed or absent.

FIG. 6 shows the sensor 19 which can be coupled via a screw coupling 26 to a screw plug 27 of a central processing unit 28.

Sensor 19 comprises a reading head 29 which is directed toward the seal 12, 20 or 22 according to the invention. In the case magnetic material is used, the specific magnetic properties of the magnetic material wire 18 will be registered via the reading head 29. In the case of the transponder 22 the transponder signal will be monitored after an adapted radio signal has been transmitted. The recorded response in the form of a specific electromagnetic signal or a radio signal is stored in the memory of the sensor and after coupling to the central processing unit 28 can later be transferred thereto.

Sensor 19 further has a display 30 on which the data of the owner of object 2 can be shown so that the operator of sensor 19 can be sent each time to a particular object 2.

The sensor 19 is further provided with means 31 for entering information recorded by the object, for instance in the case of object 2, the meter reading visible through the window 3. For this purpose the means 31 comprise a keyboard 32 with keys 33.

It is further possible for sensor 19 to be provided with means for cordless monitoring of data from electronic meters and/or with means for cordless transmission of monitored data to the central processing unit 28.

Figure 7:
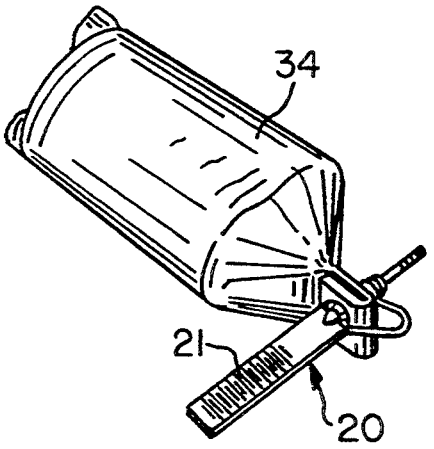
FIG. 7 shows a money-bag provided with a seal.
Figure 4:
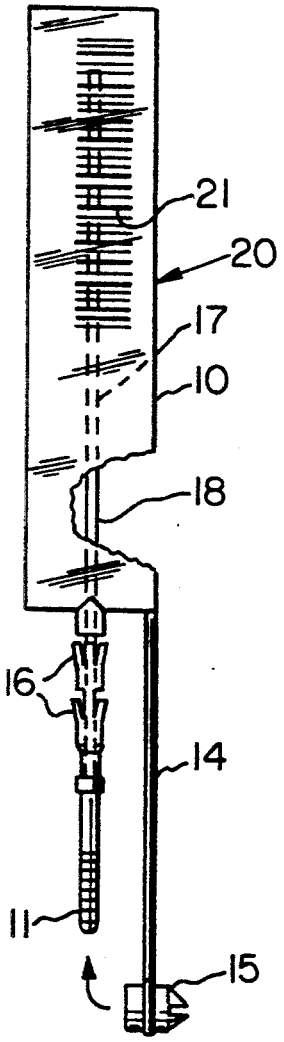

Finally, FIG. 7 shows a money-bag 34 which is closed with a seal 20 as shown in FIG. 4. By determining the integrity of seal 20 with sensor 19 it can not only be ascertained whether interim access has been gained to the contents of money-bag 34 but also for instance what type and amount of money was placed in bag 34 prior to arranging of the seal 20.

It is finally noted that an object according to the invention can be provided with more than one seal according to the invention.

We claim:

1. A sealing system for an object comprising a locking member for closing the object, a seal coupled to said locking member and provided with integrity means, and sensor means for sensing a condition of said integrity means to determine the integrity of said seal, wherein said integrity means comprises magnetic material with a low magnetic coercivity.

2. The sealing system as claimed in claim 1, wherein magnetic material has the form selected from the group consisting of a wire and a strip.

3. The sealing system as claimed in claim 2, wherein said integrity means is embedded into a plastic seal.

4. The sealing system as claimed in claim 3, wherein said locking member is a locking screw to which said seal is coupled.

5. The sealing system as claimed in claim 4, wherein said seal is provided with a unique code.

6. The sealing system as claimed in claim 5, wherein said code is a code which can be read by said sensor.

7. The sealing system as claimed in claim 6, wherein said sensor is provided with means for storing the response of said seal.

8. The sealing system as claimed in claim 7, wherein said sensor is provided with a display for showing data of the owner of the object.

9. The sealing system as claimed in claim 8, wherein said sensor is provided with means for entering a meter reading recorded by the object.

10. A sealing system for an object comprising a locking member for closing the object, a seal coupled to said locking member and provided with integrity means, and sensor means for sensing a condition of said integrity means to determine the integrity of said seal, wherein said integrity means comprises a transponder.

11. A sealing system for an object comprising a locking member for closing the object, a seal coupled to said locking member and provided with integrity means, and sensor means for sensing a condition of said integrity means to determine the integrity of said seal, wherein said seal is provided with a unique code which can be read by said sensor.

12. A sealing system for an object comprising a locking member for closing the object, a seal coupled to said locking member and provided with integrity means, and sensor means for sensing a condition of said integrity means to determine the integrity of said seal, wherein said sensor is provided with means for storing the condition of said seal.

13. A sealing system for an object comprising a locking member for closing the object, a seal coupled to said locking member and provided with integrity means, and sensor means for sensing a condition of said integrity means to determine the integrity of said seal, wherein said sensor is provided with a display for showing data of the owner of the object.

14. A sealing system for an object comprising a locking member for closing the object, a seal coupled to said locking member and provided with integrity means, and sensor means for sensing a condition of said integrity means to determine the integrity of said seal, wherein said sensor is provided with means for entering a meter reading recorded by the object.

15. The sealing system as claimed in claim 14, wherein said sensor is adapted to be coupled to a central processing unit for processing the condition measured by said sensor and said entered data.

* * * * *